United States Patent [19]

Carroll

[11] 4,104,794

[45] Aug. 8, 1978

[54] SCISSORS

[75] Inventor: Andrew C. Carroll, West Monroe, La.

[73] Assignee: The Raymond Lee Organization, Inc., New York, N.Y.

[21] Appl. No.: 824,548

[22] Filed: Aug. 15, 1977

[51] Int. Cl.[2] ..... B26B 13/00

[52] U.S. Cl. ..... 30/268

[58] Field of Search ..... 30/254, 267, 268, 269, 30/270

[56] References Cited

U.S. PATENT DOCUMENTS

| | | | |
|---|---|---|---|
| 844,903 | 2/1907 | Wilkins | 30/268 |
| 1,987,935 | 1/1935 | Herrick | 30/268 |
| 2,741,844 | 4/1956 | Sejman et al. | 30/268 |
| 3,672,053 | 6/1972 | Wiss | 30/267 |
| 3,740,846 | 6/1973 | Duffy | 30/267 |

*Primary Examiner*—Jimmy C. Peters

*Attorney, Agent, or Firm*—Howard I. Podell

[57] ABSTRACT

A scissors, the blades of which are held together by spring bias of a bolted assembly. The bolted assembly is in the form of a screw, a pair of split ring washers and a nut. The screw head is pinned to one blade through the screw head and the nut is fitted with a radial nylon plug so to adjustably fasten in frictional engagement to the screw.

2 Claims, 8 Drawing Figures

SCISSORS

SUMMARY OF THE INVENTION

My invention is a scissors, the blades of which are held together by spring bias of a bolted assembly. The bolted assembly is in the form of a screw, a pair of split ring washers and a nut. The screw head is pinned to one blade through the screw head and the nut is fitted with a radial nylon plug so to adjustably fasten in frictional engagement to the screw.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
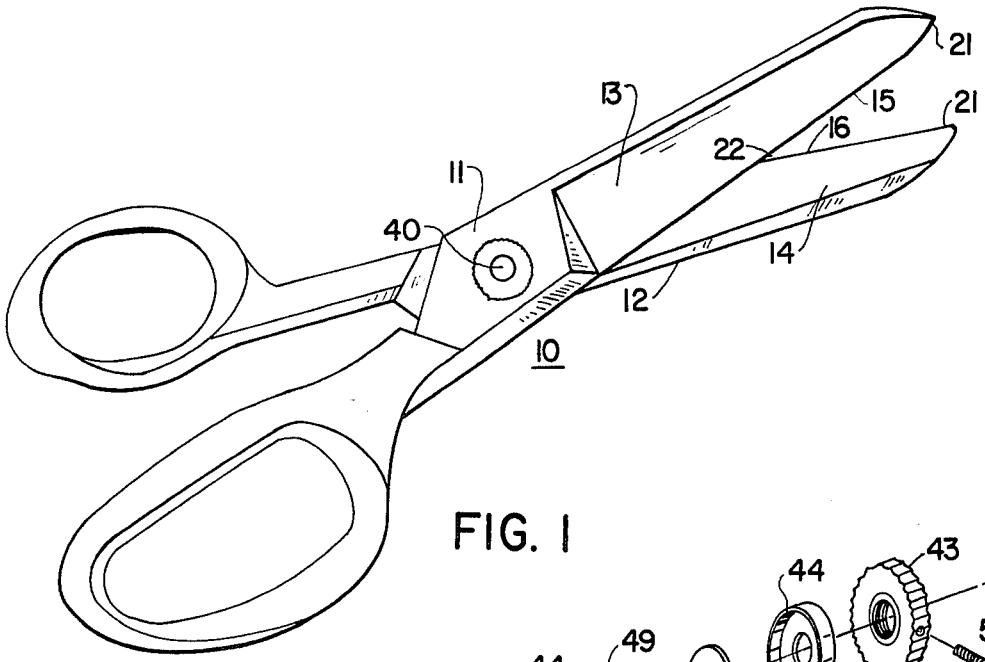
FIG. 1 is a perspective view of a scissors of the invention.
Figure 4:
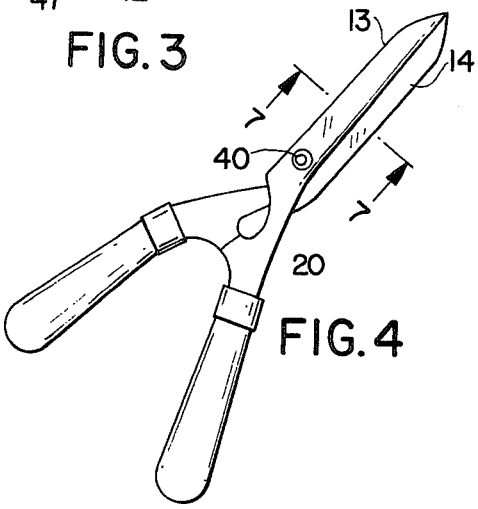
FIG. 4 is a plan view of a shears of the invention; in the closed position.
Figure 5:
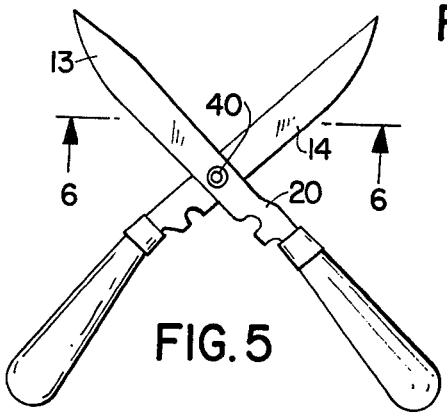
FIG. 5 is a view of the shears of the invention; in the open position.
Figure 8:
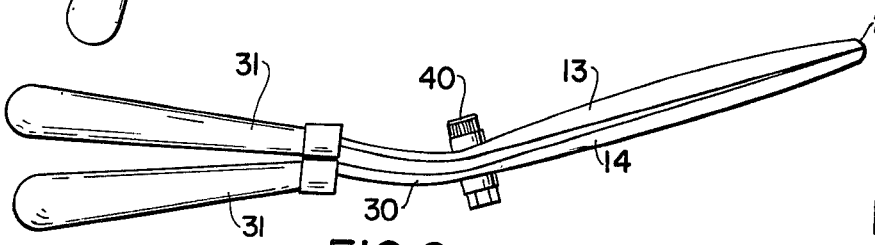
FIG. 8 is a side view of the shears.

Turning now descriptively to the drawings, in which similar reference characters denote similar elements throughout the several views, FIG. 1 illustrates a scissors 10 formed of two blade members 11, 12 pivotally joined by bolt assembly 40, FIGS. 4–5 illustrate a similar shears 20, with shear blade members 21, 22 similarly joined by bolted assembly 40. FIG. 8 illustrates an alternate embodiment 30 of shears 20.

Figure 6:
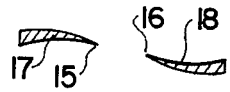
FIG. 6 is a sectional view of the blades, taken along line 6—6 of FIG. 5.
Figure 7:
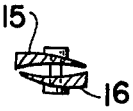
FIG. 7 is a sectional view of the blades, taken along line 7—7 of FIG. 4.

The cutting blades 13, 14 are spaced apart at the bolted assembly 40 with blades 13, 14 contacting each other only at the respective cutting edges 15, 16, with the inner surface 17, 18 blades 13, 14 curved along a concave arcuate path in transverse cross-section as shown in FIGS. 6, 7. Blades 13 and 14 are also bent in longitudinal section so that in the closed position, the cutting edges contact each other at the tip 21 of the blades and contact each other at the intersection 22 of the cutting edges in the open position.

Bolt assembly 40 fits through a pivot hole in each blade, with bolt assembly 40 comprising a flat head screw 41, a pair of split ring lock washers 42, a round frictional knurled self-locking nut 43 and a pair of lockwasher covers 44. Each lock washer cover 44 is in the form of a washer with a projecting sleeve rim 40 that fits about the sides of an enclosed lock-washer.

Figure 2:
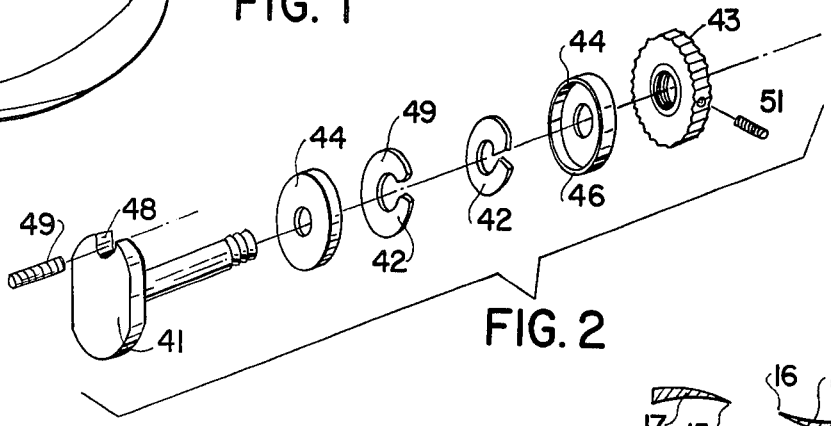
FIG. 2 is an exploded view of the bolt assembly.
Figure 3:
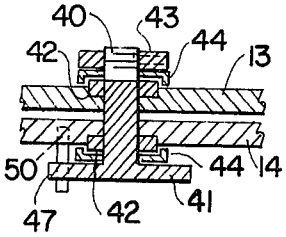
FIG. 3 is a sectional view of the invention, taken at the pivot of FIG. 1.

Bolt assembly is put together as shown in FIGS. 2–3 with a lockwasher 42 bearing externally against each blade member, and enclosed in a cover 44 bearing against the screw head 47 or nut 43.

Screw head 47 is formed with a hole or slot 48 through which a pin 49 may be fixed to engage a hole 50 in an abutting blade 14 so as to latch screw 41 in non-rotatable engagement with blade 14. Nut 43 may be fitted with an axial plug 51 of nylon to form a frictional latch with the engaged male screw thread of screw 41, or otherwise shaped to frictionally engage screw 41 in a self-locking manner.

In use, particularly in cutting thick material such as double knit goods, the material being cut will force both blades away from each other except along the intersection of the cutting edges of the blades and the spring bias of split ring lockwashers 42 against each blade may be adjusted by rotation of nut 43, relative to screw 41. Screw 41 cannot rotate with respect to abutting blade 14 and self-locking nut cannot freely rotate with regard to screw 41, once adjusted by hand torque.

Lockwashers 42 are of conventional size, shape and material, being generally formed of a spring temper material with the opposing end portion 49 bent away from each other.

Shears 20 are of similar construction to scissors 10 with shears 30 similarly formed except for handle sections 31 that are bent in a plane at an angle to the plane of the blade members 13, 14.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is:

1. A scissors the two blades of which are pivotally joined by a bolted assembly, said bolted assembly comprising
   - a headed screw
   - a pair of split ring lock washers
   - a pair of lockwasher covers, and
   - a self-locking nut,
   - said assembly mounted through a pivot hole in each scissors blade with the inner faces of the two blades spaced apart from each other, with a lockwasher bearing on each external face of each blade, a lockwasher cover bearing against and enclosing the sides of each lockwasher, with the head of the screw bearing against one cover and the nut, threaded to the screw, bearing against the other cover, together with means to latch the head of the screw in non-rotatable engagement with the adjacent blade.

2. The combination as recited in claim 1 in which a pin is mounted through a hole in the head of the screw and a hole in the head of the screw and a hole in the adjacent blade to serve as the latch means.

* * * * *